US010101105B1

(12) United States Patent
Novak et al.

(10) Patent No.: US 10,101,105 B1
(45) Date of Patent: Oct. 16, 2018

(54) MAGAZINE INSERTION FUNNEL

(71) Applicant: Sportco, Inc., Holbrook, NY (US)

(72) Inventors: Robert Arthur Novak, Holbrook, NY (US); Joseph Michael Procopio, Sayville, NY (US); Jameson Stradley Ellis, Sag Harbor, NY (US); Jayson Edward Dekmar, Grandville, MI (US)

(73) Assignee: Sportco, Inc., Holbrook, NY (US)

( * ) Notice: Subject to any disclaimer, the term of this patent is extended or adjusted under 35 U.S.C. 154(b) by 0 days.

(21) Appl. No.: 15/951,344

(22) Filed: Apr. 12, 2018

Related U.S. Application Data

(63) Continuation of application No. 29/633,924, filed on Jan. 17, 2018, which is a continuation of application No. 29/629,057, filed on Dec. 11, 2017.

(51) Int. Cl.
*F41A 9/65* (2006.01)
*F41A 35/00* (2006.01)

(52) U.S. Cl.
CPC ..... *F41A 9/65* (2013.01); *F41A 35/00* (2013.01)

(58) Field of Classification Search
CPC ..... F41A 9/61; F41A 9/65; F41A 9/66
USPC ..... 42/50, 7, 6, 49.01, 49.02, 90
See application file for complete search history.

(56) References Cited

U.S. PATENT DOCUMENTS 3,999,321 A * 12/1976 Musgrave ..... F41C 23/10 42/71.02
D529,983 S * 10/2006 Yu ..... D22/108
7,743,542 B1 * 6/2010 Novak ..... F41C 23/10 42/49.02
8,127,480 B1 * 3/2012 McManus ..... F41A 9/82 42/49.02
2010/0154275 A1 * 6/2010 Faifer ..... F41A 9/61 42/90

* cited by examiner

*Primary Examiner* — Reginald S Tillman, Jr.
(74) *Attorney, Agent, or Firm* — Abelman, Frayne & Schwab

(57) ABSTRACT

A magazine insertion funnel for facilitating the insertion of a magazine into an aperture of a firearm designed for receiving the magazine. The funnel includes a central well with a narrow opening to be positioned adjacent to the aperture, and a wide opening that is distal from the aperture. The well includes a narrow section that is adjacent to the aperture, a wide section that is distal from the aperture, and a waist dividing the two sections. The narrow section has a first frustorectangular shape at a first insertion angle, and the wide section has a second frustorectangular shape at a second insertion angle. The second insertion angle is larger than the first insertion angle.

10 Claims, 15 Drawing Sheets

MAGAZINE INSERTION FUNNEL

CLAIM FOR PRIORITY

This application is a continuation of and claims priority to and incorporates by reference U.S. Design patent application No. 29/629,057, filed on 11 Dec. 2017, and U.S. Design patent application No. 29/633,924, filed on 17 Jan. 2018.

FIELD OF THE INVENTION

This invention relates to weapon accessories and more particularly to a magazine insertion funnel, also known as a magazine well or magwell, which aids a user in guiding a removable magazine into an aperture of a firearm receiver designed to accept that magazine.

BACKGROUND OF THE INVENTION

Firearms have been produced with a variety of different designs for storage of ammunition. One popular design incorporates the storage of rounds of ammunition in removable magazines that fit within an aperture of the firearm receiver. The use of such removable magazines provides certain advantages, such as rapidly loading and unloading the firearm with a magazine that may contain a number of rounds of ammunition. Another advantage is allowing a user to carry one or more extra magazines that are also loaded with additional rounds of ammunition.

A magazine is a box with an approximately rectilinear shape that fits through an aperture of the firearm receiver and into the firearm's internal magazine well that has a similar shape and size to that of the magazine. There is typically a close tolerance between the magazine, the aperture, and the internal magazine well, to keep the magazine securely in place in the firearm for safety and dependability. Because of that close tolerance, when a user wants to place a removable magazine through the aperture of the firearm, he typically has to align the magazine precisely with the aperture. If the user is in a stressful environment, however, and especially if time is of the essence, then the proper alignment of the magazine with the aperture can become more difficult and time-consuming. Oftentimes, the user will waste precious seconds while attempting to properly align the magazine with the aperture, and may fumble when trying to align and insert the magazine through the aperture. Examples of stressful environments for the user include organized competitive events, which are generally timed events. Other stressful environments include law enforcement or military use and/or field training exercising.

If the approximately rectangular end of the magazine is offset somewhat from the similarly-shaped aperture, the user will be unable to insert the magazine into the firearm's internal magazine well. The user will then have to reposition the magazine to precisely place the end of the magazine through the aperture. Furthermore, even if the user has placed the end of the magazine through the aperture, the user will need to continue inserting the magazine so that the exterior walls of the magazine remain parallel to the walls of the internal magazine well. If the user instead inadvertently pushes the magazine to one side while beginning the insertion into the internal magazine well, the magazine could temporarily jam against the wall of the internal magazine well.

One prior art solution to this problem is a magazine insertion funnel, an accessory that is semi-permanently installed on the firearm receiver. The magazine insertion funnel incorporates a narrow opening, positioned adjacent to the aperture, and a wide opening that offers a larger target for inserting the removable magazine. Instead of the walls of the magazine insertion funnel residing in planes that are parallel or perpendicular to each other, as are the walls of both the magazine and the internal magazine well, the walls within the typical magazine insertion funnel are angled so that as a magazine is inserted, the interior walls of the funnel get closer to each other, so that magazine is funneled toward the aperture, at the opening to the internal magazine well.

While prior art magazine insertion funnels may offer an improvement over a firearm lacking any accessory for its aperture and internal magazine well, a rapid insertion of a magazine into such a prior art magazine insertion funnel can still lead the magazine to be guided by a sloped interior wall to the opposite wall, rather than being guided into the firearm aperture.

What is needed is an improved magazine insertion funnel that allows for accurate and fast loading of a magazine through the aperture of a firearm into the internal magazine well, while minimizing the need for a user to have to perfectly align the end of the magazine with the similarly sized aperture, and minimizing the need for the user to have to ensure that the walls of the magazine are parallel to the corresponding walls of the internal magazine well. This will help to prevent jamming the magazine upon insertion into the firearm.

SUMMARY OF THE INVENTION

The present invention provides a substantial improvement in the design of a magazine insertion funnel. It incorporates within a single central well a narrow opening (to be positioned adjacent to the aperture of a firearm receiver) and a wide opening. An axis passes through the center of the narrow opening and the wide opening. The well includes a narrow section that is adjacent to the narrow opening, a wide section that is adjacent to the wide opening, and a waist dividing the narrow section from the wide section. The narrow section includes a first frustorectangular shape, and the wide section includes a second frustorectangular shape. The first frustorectangular shape of the narrow section has a first insertion angle, with relation to the axis, while the second frustorectangular shape of the wide section has a second insertion angle, with relation to the axis. The first insertion angle is smaller than the second insertion angle.

As a user inserts a magazine into the wide section via the wide opening, the magazine may be guided by one or more walls of the second frustorectangular shape at the larger second insertion angle, and then as the magazine is advanced past the waist, it may be guided by the first frustorectangular shape at the smaller first insertion angle, so that the magazine will be guided more closely to the position and angle required to pass through the aperture and into the internal magazine well of the firearm receiver without jamming.

The magazine insertion funnel configured and arranged as described will provide improved functionality.

BRIEF DESCRIPTION OF THE DRAWINGS

Preferred embodiments of the invention are described herein below with reference to the drawings wherein.

DETAILED DESCRIPTION OF THE INVENTION

The present invention is directed towards a magazine insertion funnel for use with a firearm accepting a removable magazine into an aperture of the firearm.

Figure 1:
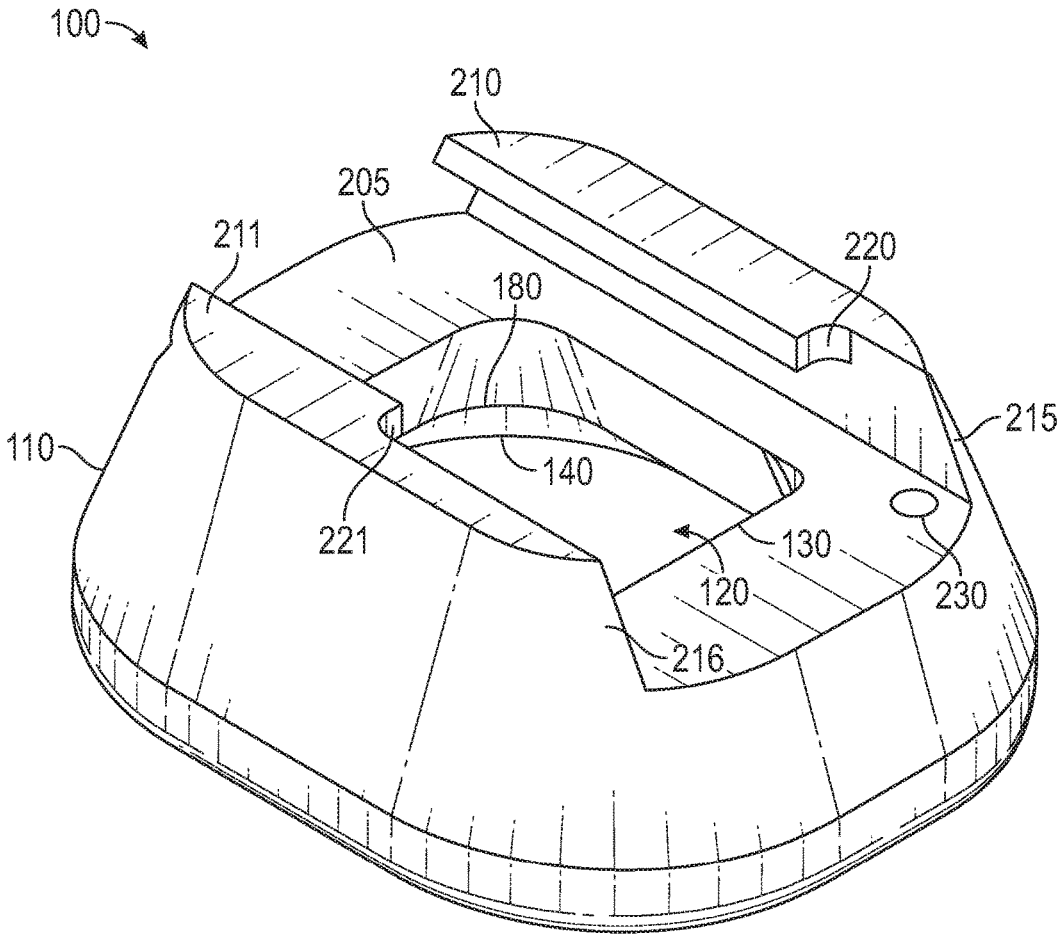
FIG. 1 is a front, right, and top perspective view of one embodiment of the magazine insertion funnel.
Figure 2:
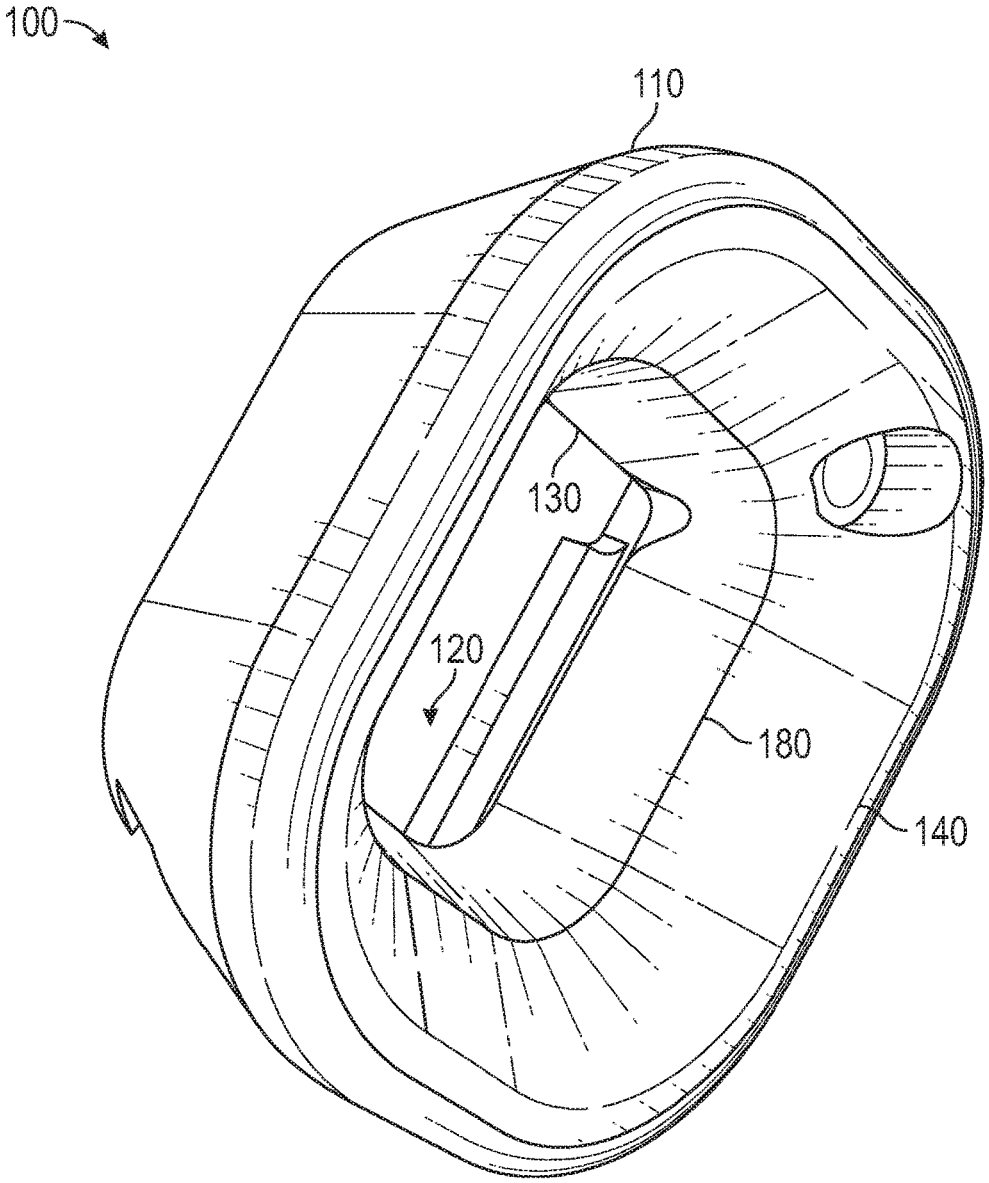
FIG. 2 is a front, left, and bottom perspective view thereof.
Figure 3:
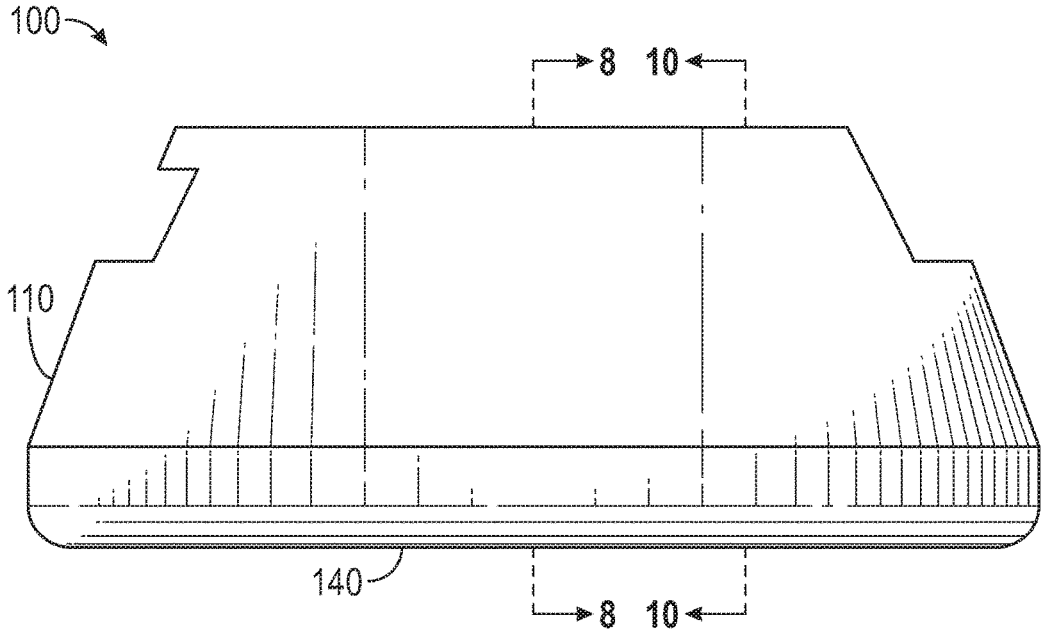
FIG. 3 is a front elevation view thereof, the rear elevation view being a mirrored image thereof.
Figure 4:
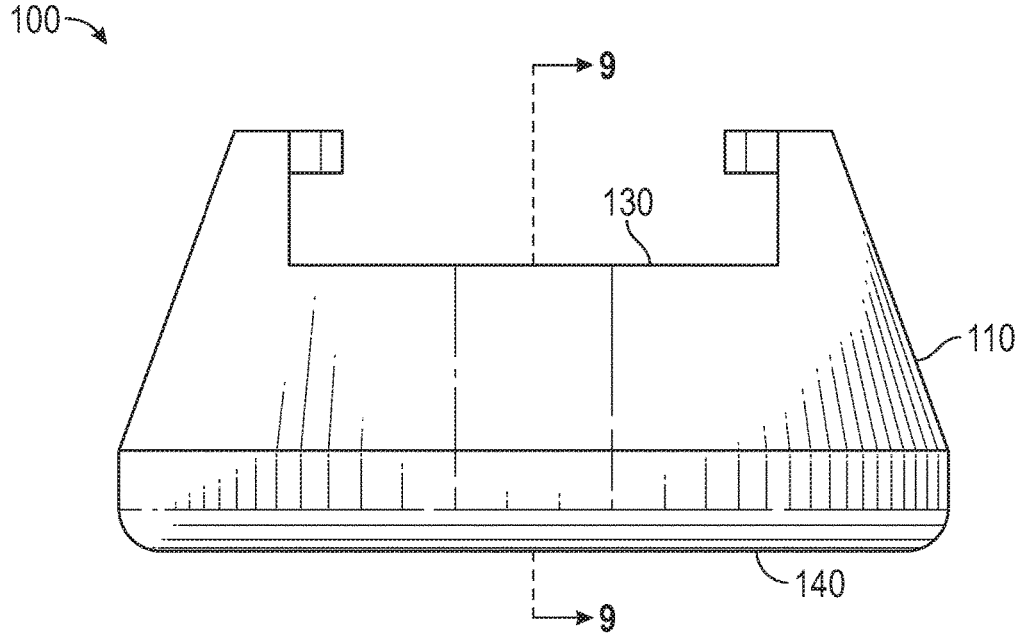
FIG. 4 is a right side elevation view thereof.
Figure 5:
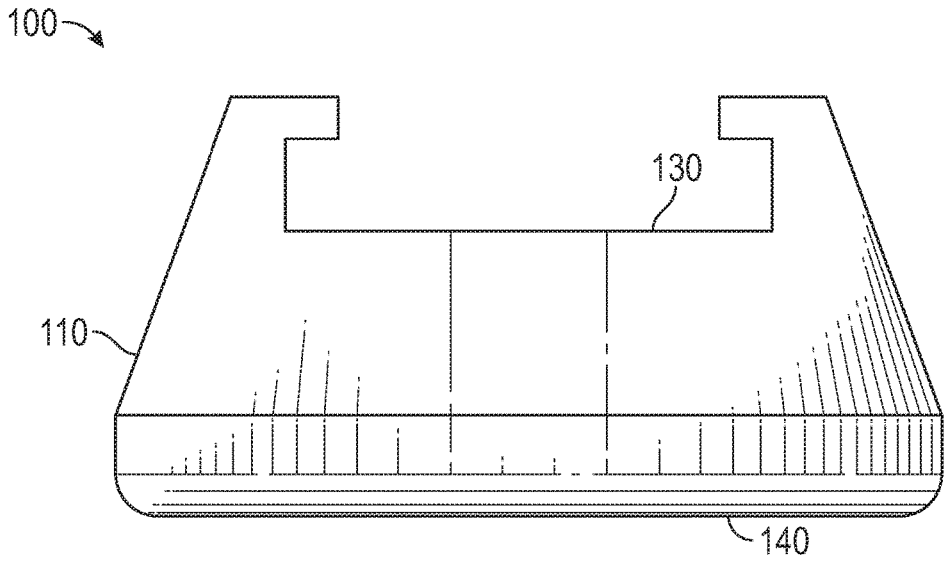
FIG. 5 is a left side elevation view thereof.
Figure 6:
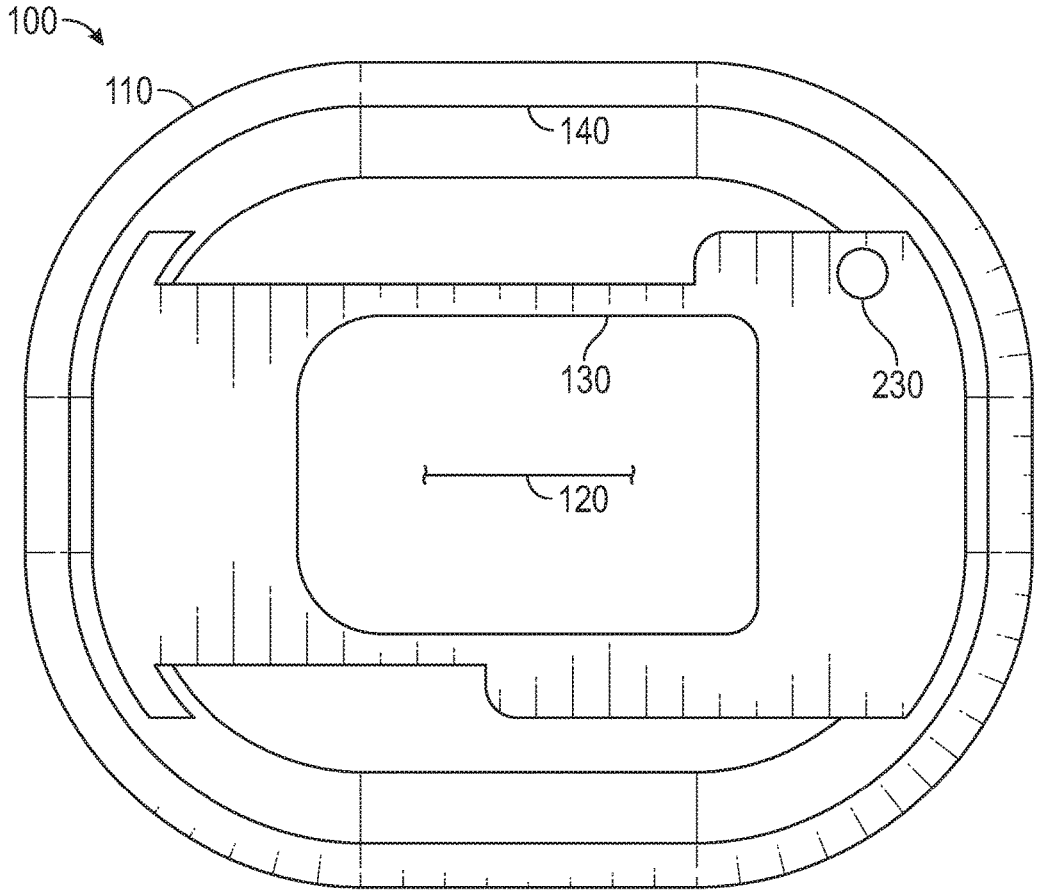
FIG. 6 is a top plan view thereof.

FIGS. 1-10 show various views of one embodiment of magazine insertion funnel 100. As shown in FIG. 1, magazine insertion funnel 100 includes a body 110 and a central well 120 that includes a narrow opening 130 and a wide opening 140.

Figure 10:
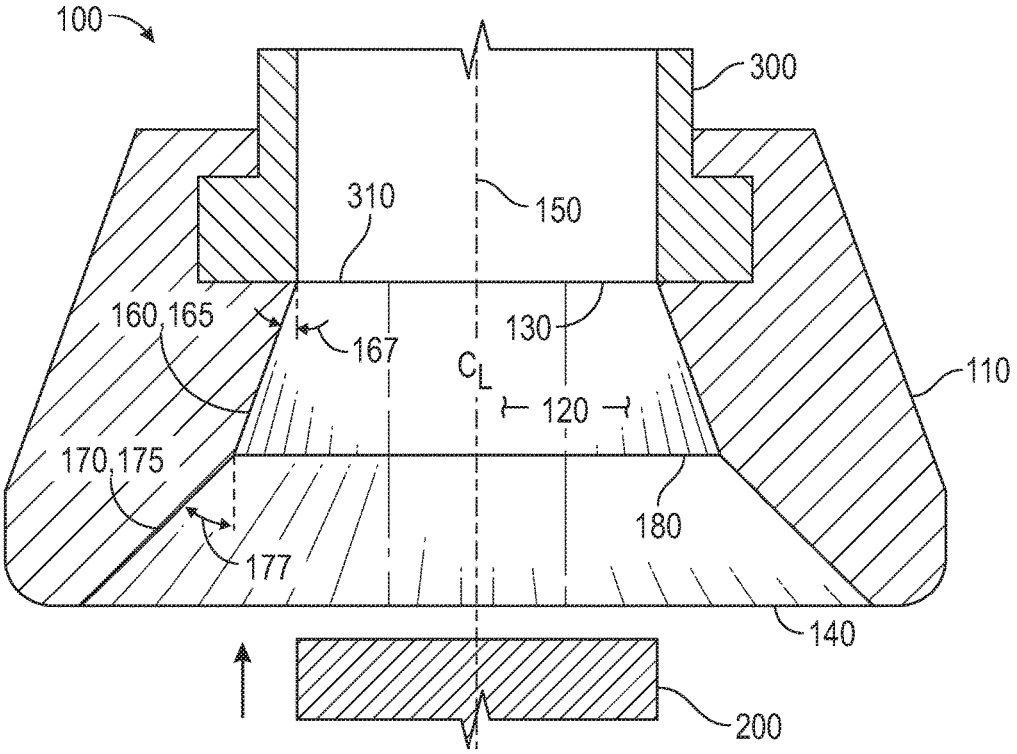
FIG. 10 is a section along lines 10-10 of FIG. 3

FIG. 10 shows a sectional view of magazine insertion funnel 100 after it has been installed on a firearm receiver 300. Narrow opening 130 aligns adjacent to a generally rectangular aperture 310 of firearm receiver 300 that is designed to receive a magazine 200. Wide opening 140 is distal from the aperture 310. Magazine 200 is shown adjacent to the wide opening 140 of magazine insertion funnel 100, ready for insertion into the wide opening 140, through the well 120, through the narrow opening 130, and through aperture 310 and into the firearm receiver 300. An axis 150 extends from the center of the narrow opening 130 and the center of the wide opening 140.

FIG. 10 also shows that well 120 comprises a narrow section 160, a wide section 170, and a waist 180 dividing the narrow section 160 from the wide section 170. The waist has a circumference greater than that of the narrow opening 130 but less than that of the wide opening 140.

The narrow section 160, which extends from the narrow opening 130 to the waist 180, comprises a first frustorectangular shape 165 at a first acute angle 167 with reference to the axis 150. The four corners 168 between the four walls 169 of the first frustorectangular shape 165 are filleted.

The wide section 170, which extends from the waist 180 to the wide opening 140, comprises a second frustorectangular shape 175 at a second acute angle 177 with reference to the axis 150. The four corners 178 between the four walls 179 of the first frustorectangular shape 175 are filleted.

In a preferred embodiment, first acute angle 167 is between 20-30 degrees. More preferably, first acute angle 167 is between 24-26 degrees. More preferably, first acute angle 167 is 25 degrees.

Second acute angle 177 is greater than first acute angle 167, by at least 15 degrees. In a preferred embodiment, second acute angle 177 is between 50-70 degrees. More preferably, second acute angle 177 is between 40-55 degrees. More preferably, second acute angle 177 is 45 degrees.

It may thus be comprehended that well 120 serves as a funnel such that a removable magazine 200 inserted into the bottom of well 120 may first contact any of one or more walls 179 of the second frustorectangular shape 175, and will then be funneled upward toward first frustorectangular shape 165 at an angle from axis 150 not greater than second acute angle 177. The removable magazine will then contact any of one or more walls 169 of first frustorectangular shape 165, and will then be funneled upward toward aperture 310 of firearm receiver 300 at a lesser angle (with reference to axis 150) that is not greater than first acute angle 167. In other words, the second frustorectangular shape 175 acts as a broad funnel, and then the first frustorectangular shape 165 acts as a narrow funnel, aiding insertion of magazine 200 into the aperture 310.

Figure 7:
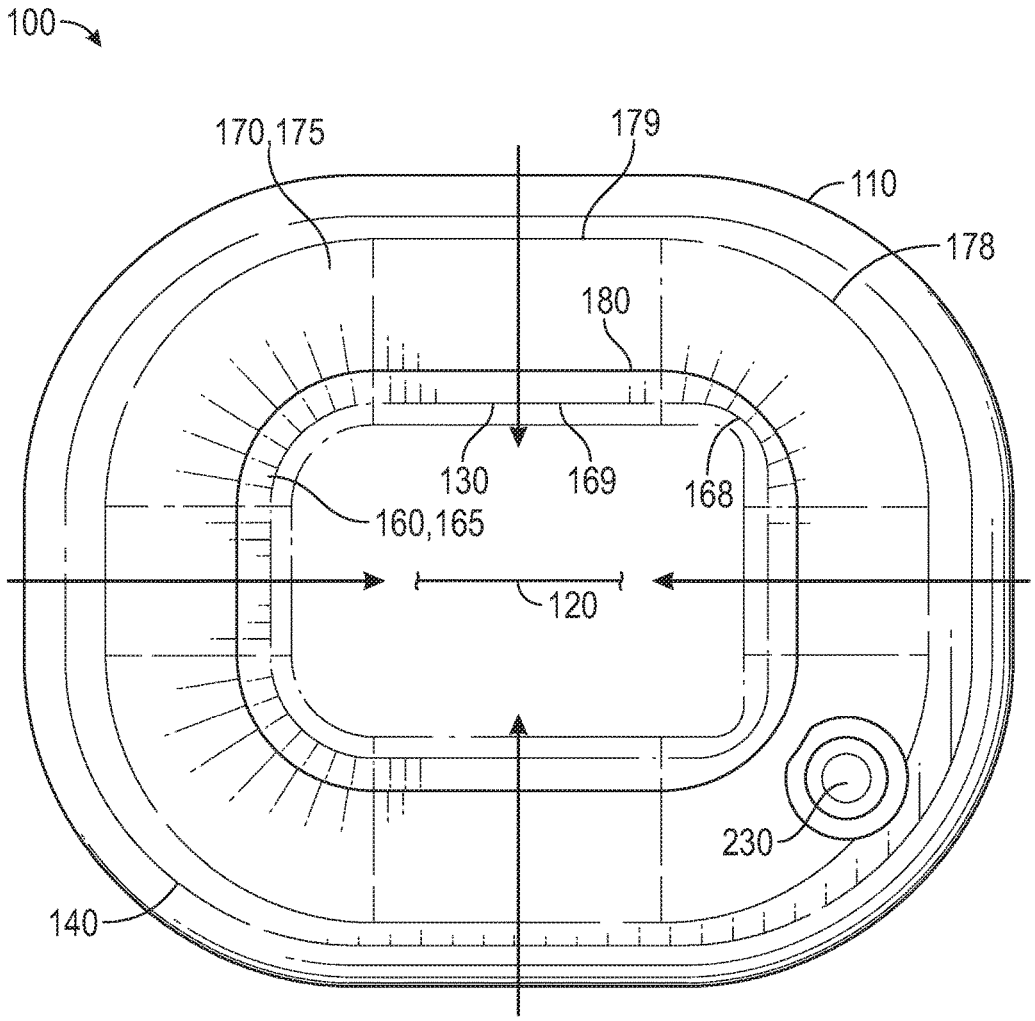
FIG. 7 is a bottom plan view thereof.
Figure 8:
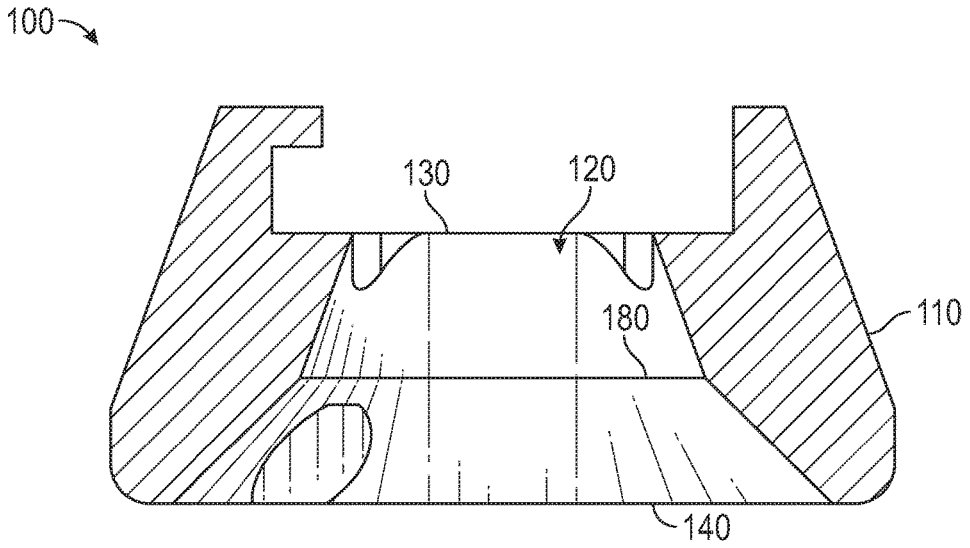
FIG. 8 is a section along lines 8-8 of FIG. 3.
Figure 9:
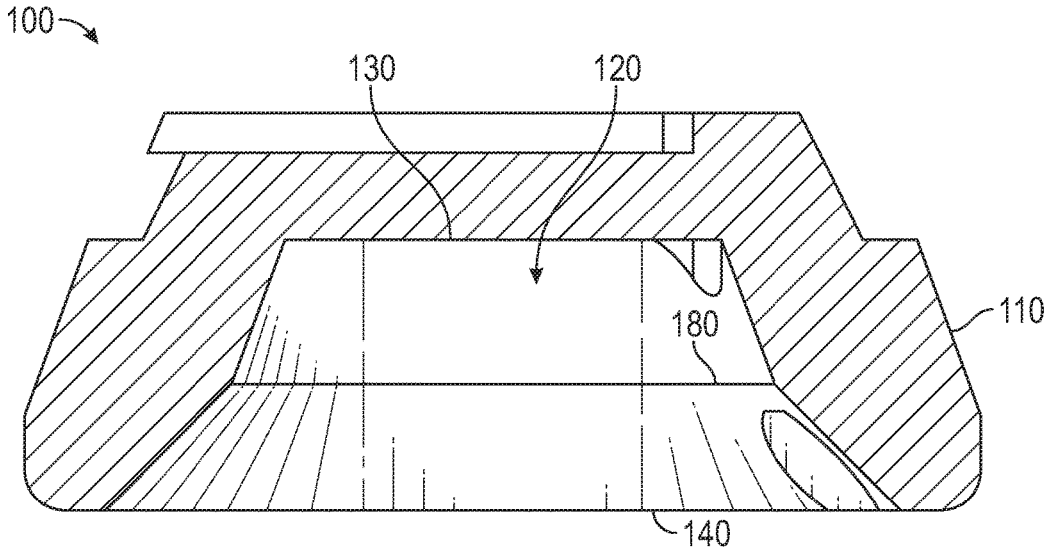
FIG. 9 is a section along lines 9-9 of FIG. 4.

FIG. 7 also shows, from the point of view of wide opening 140, the narrow section 160 with its first frustorectangular shape 165, with walls 169 having filleted joints 168, and the wide section 170 with its second frustorectangular shape 175, with walls 179 having filleted joints 178. The walls 169 of the first frustorectangular shape 165 and the walls 179 of the second frustorectangular shape 175 are angled towards the narrow opening 130, in order to direct a magazine 200 into the aperture 310 of the firearm, as generally indicated by the arrows.

For attaching magazine insertion funnel 100 to firearm receiver 300, and with reference to FIG. 1, the body 110 of magazine insertion funnel 100 includes an upper surface 205 and a pair of securing members 210, 211. The securing members 210, 211 include a leg portion 215, 216 that terminates in an inwardly disposed flange 220, 221. Magazine insertion funnel 100 can be slid onto a flange 320 of firearm receiver 300, with securing members 210, 211 gripping the flange 320, so that upper surface 205 rests against the bottom of flange 320.

Figure 11:
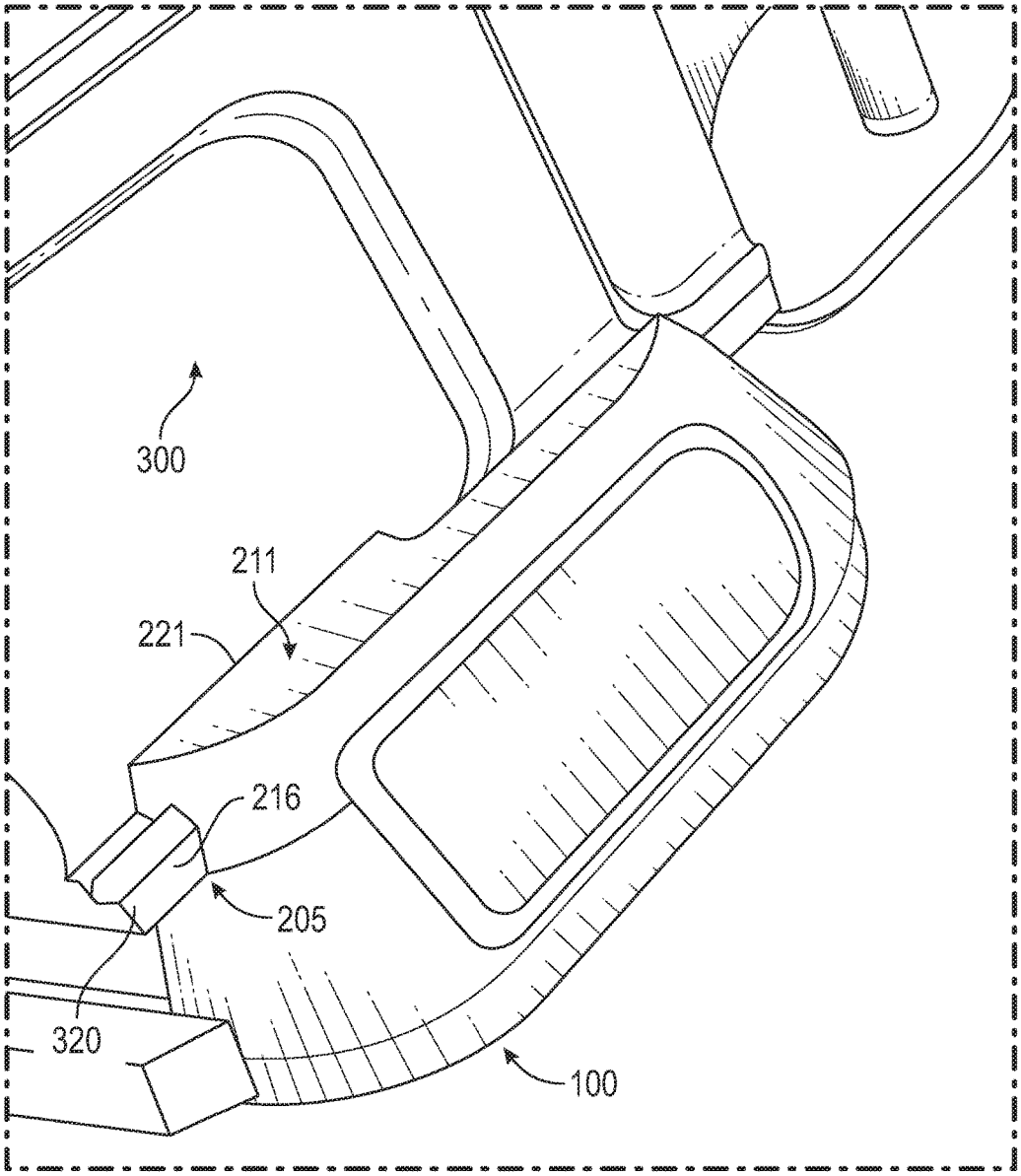
FIG. 11 is a top, left, and front perspective view of the magazine insertion funnel installed on the receiver of a firearm.
Figure 12:
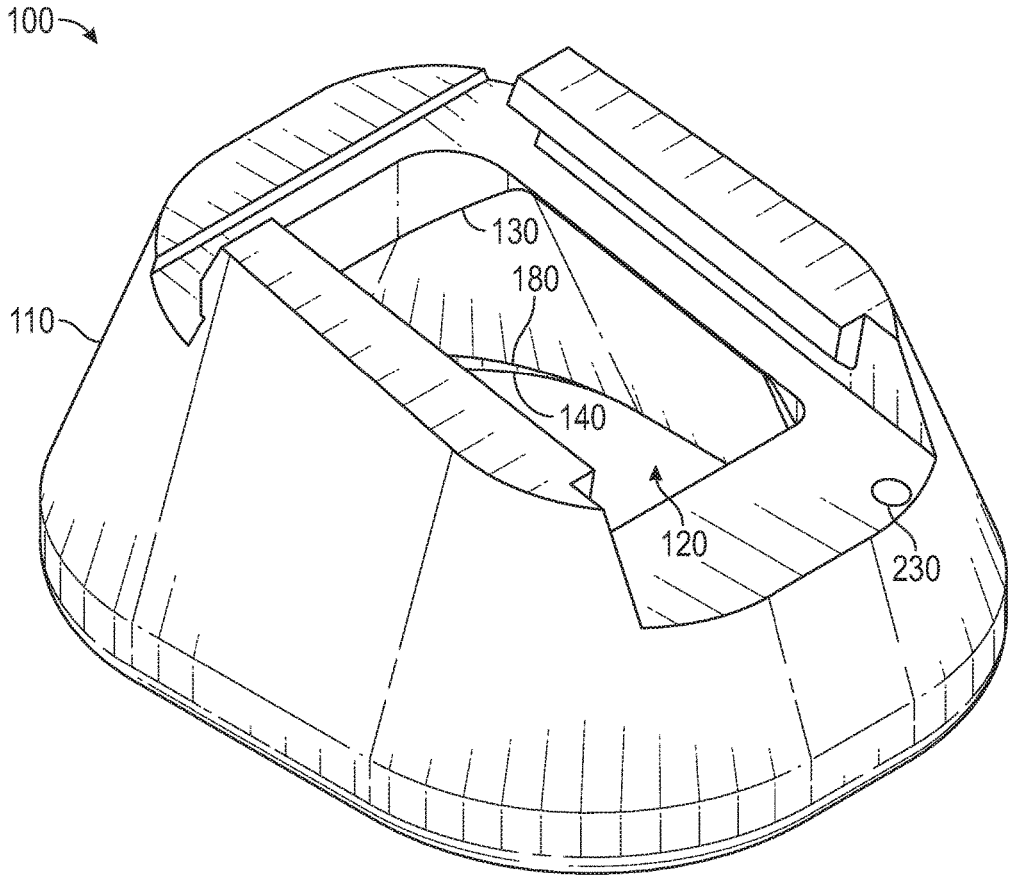
FIG. 12 is a front, right, and top perspective view of a second embodiment of the magazine insertion funnel.
Figure 13:
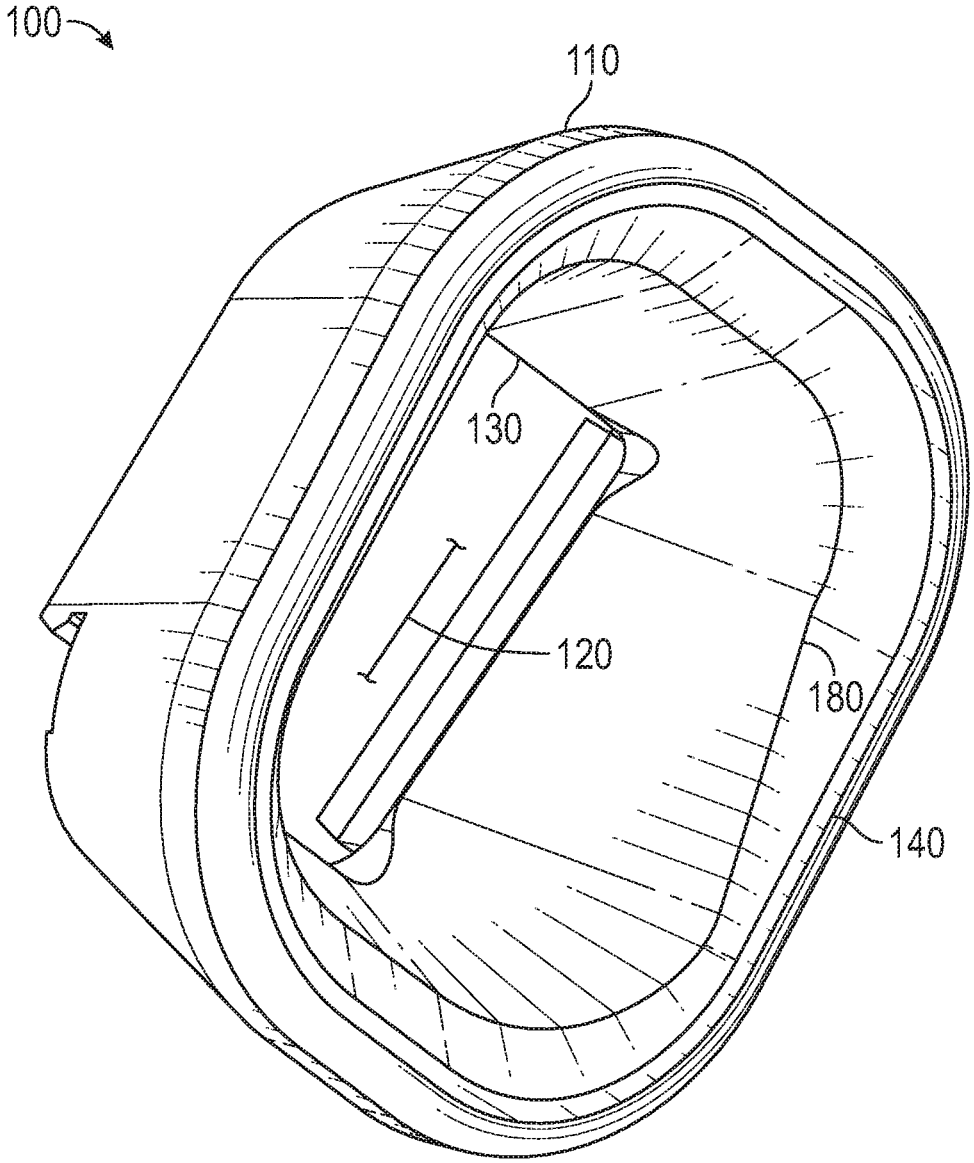
FIG. 13 is a front, left, and bottom perspective view thereof.
Figure 14:
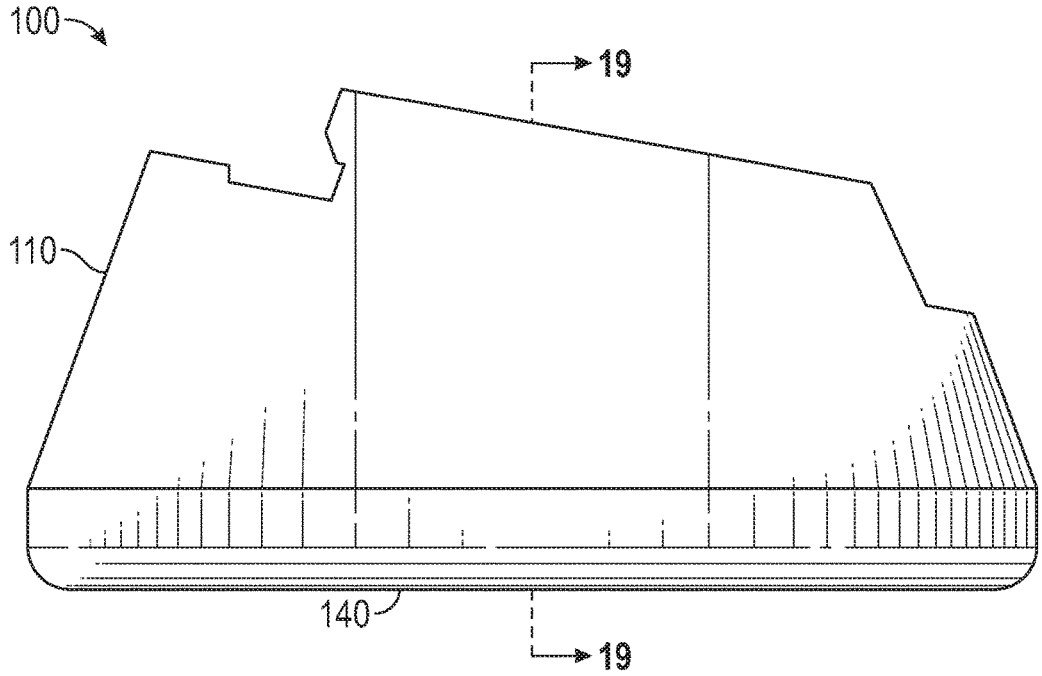
FIG. 14 is a front elevation view thereof, the rear elevation view being a mirrored image thereof.
Figure 15:
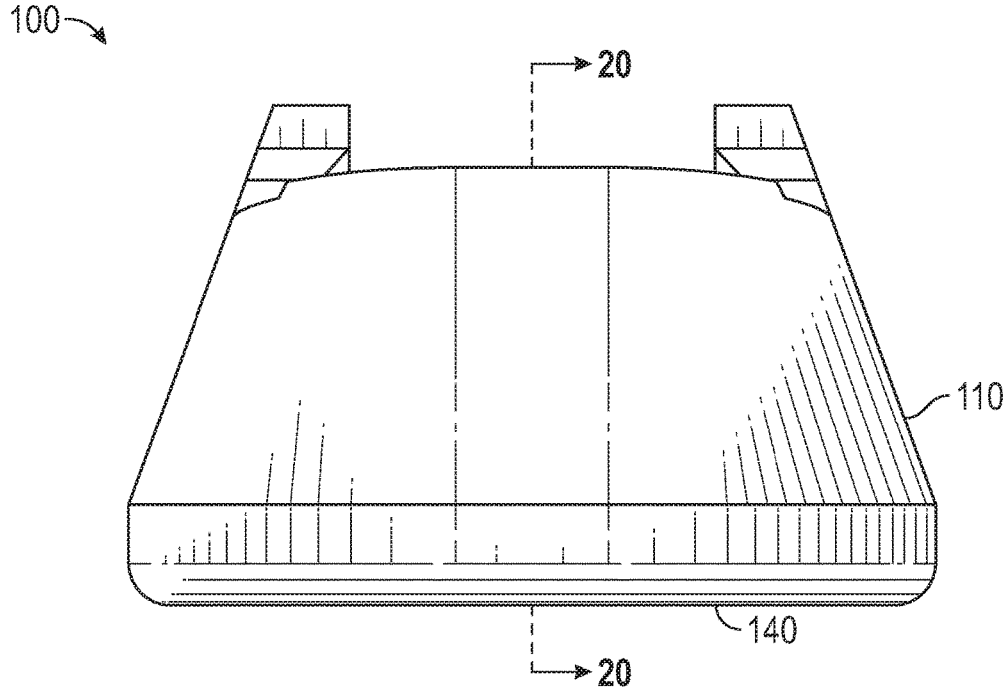
FIG. 15 is a right side elevation view thereof.
Figure 16:
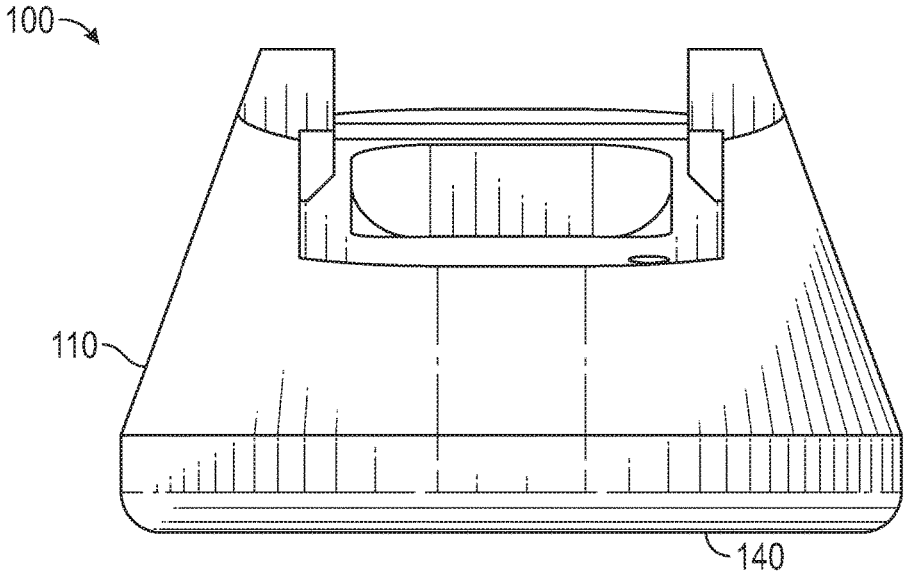
FIG. 16 is a left side elevation view thereof.
Figure 17:
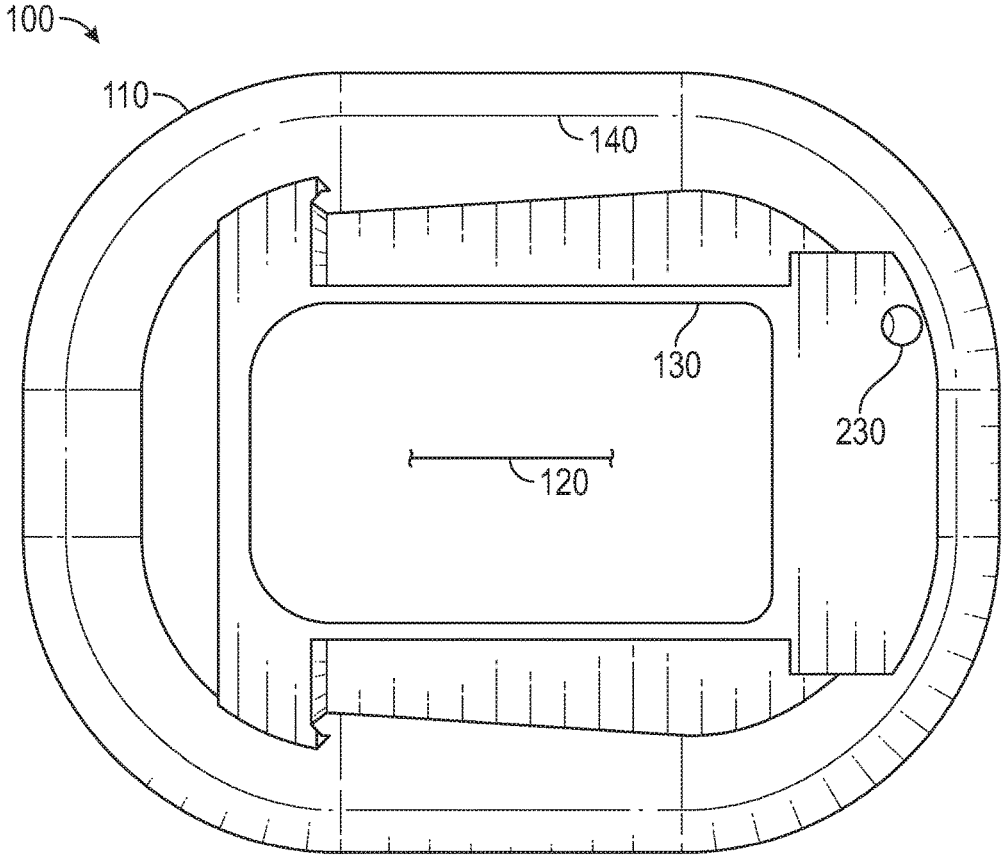
FIG. 17 is a top plan view thereof.
Figure 18:
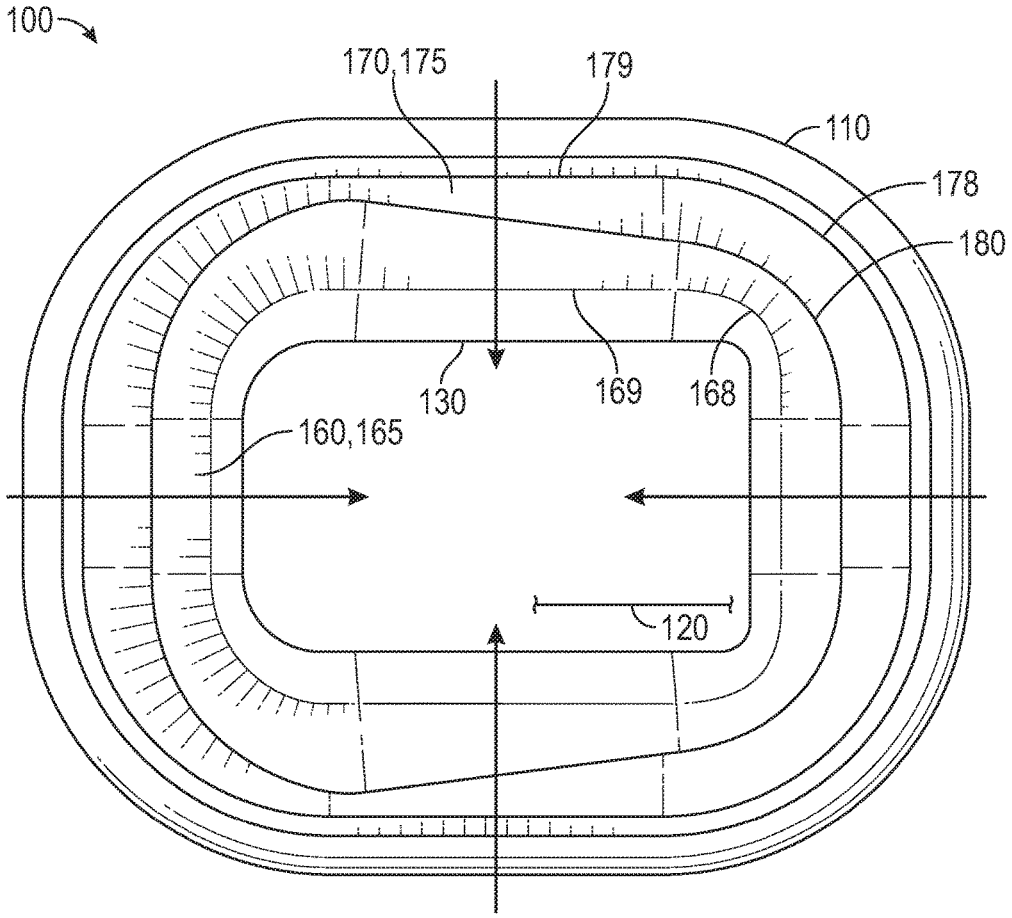
FIG. 18 is a bottom plan view thereof.
Figure 19:
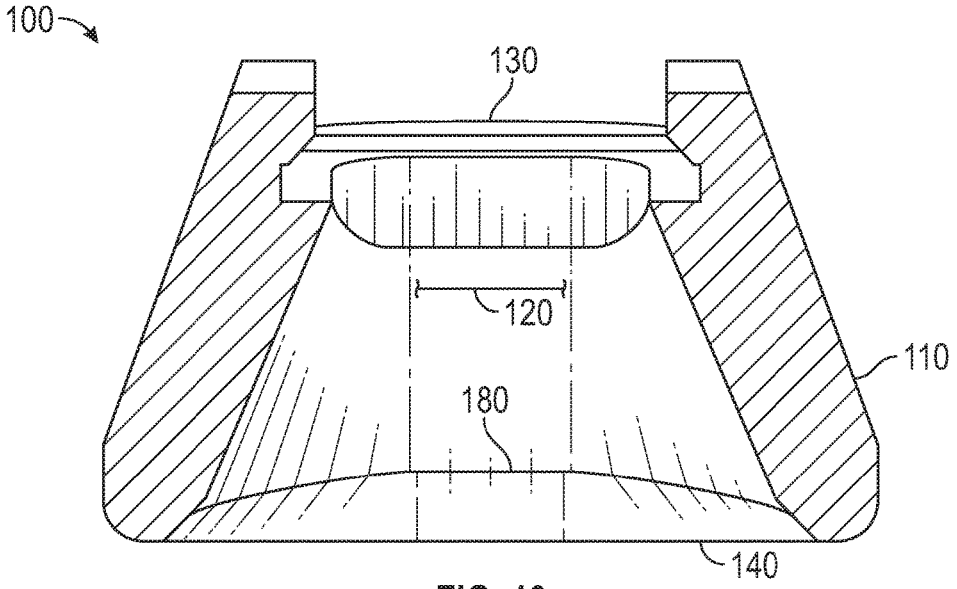
FIG. 19 is a section along lines 19-19 of FIG. 14.

FIG. 11 illustrates the magazine insertion funnel 100 installed on firearm receiver 300. Securing member 211, leg portion 216, and inwardly disposed flange 221 can be seen, and that securing member 211 is gripping flange 320 of firearm receiver 300, with upper surface 205 resting against the bottom of flange 320.

Magazine insertion funnel 100 can include an opening 230 for receiving a screw, by which after being slid onto flange 320, a screw can be inserted so that magazine insertion funnel 100 cannot slide back off flange 320. In that manner, the narrow opening 130 will be immovably aligned with aperture 310.

FIGS. 12 through 20 illustrate a second embodiment of magazine insertion funnel 100 that share all the features listed above. The differences between the first and second embodiment are as follows.

In the first embodiment of FIGS. 1 through 10, the magazine insertion funnel 100 is designed to be installed onto a firearm receiver 300 in which the plane of aperture 310 is perpendicular to axis 150. The planes of narrow opening 130, wide opening 140, waist 180, and upper surface 205 are all parallel to each other. The first frustorectangular shape 165 takes up the entirety of the narrow section 160, and the second frustorectangular shape 175 takes up the entirety of the wide section 170.

Figure 20:
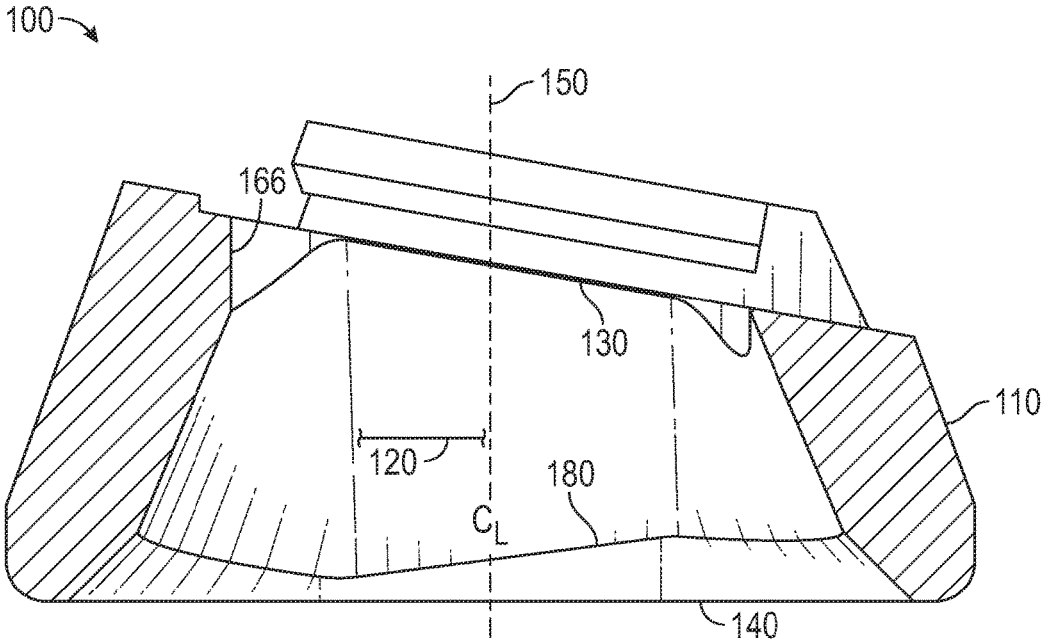
FIG. 20 is a section along lines 20-20 of FIG. 15.

In the second embodiment of FIGS. 12 through 20, the magazine insertion funnel 100 is designed to be installed onto a firearm receiver 300 in which the plane of aperture 310 is not perpendicular to axis 150. Thus, the plane of the upper surface 205 is parallel with the plane of narrow opening 130, but those two planes are not parallel with the plane of the wide opening 140. The first frustorectangular shape 165 takes up only a portion of the narrow section 160, as there is an axial wall 166, as shown in FIG. 20, that is parallel to the axis 150, such that part of the shape of the narrow section 160 is not frustorectangular. In addition, the waist 180 (which defines the wide part of the first frustorectangular shape 165 and the narrow part of the second frustorectangular shape 175) does not form a plane in the embodiment shown in FIGS. 12 through 20. In an alternative embodiment, the waist 180 could form a plane, that may or may not be parallel to either the plane of the narrow opening 130 or the plane of the wide opening 140.

Figure 21:
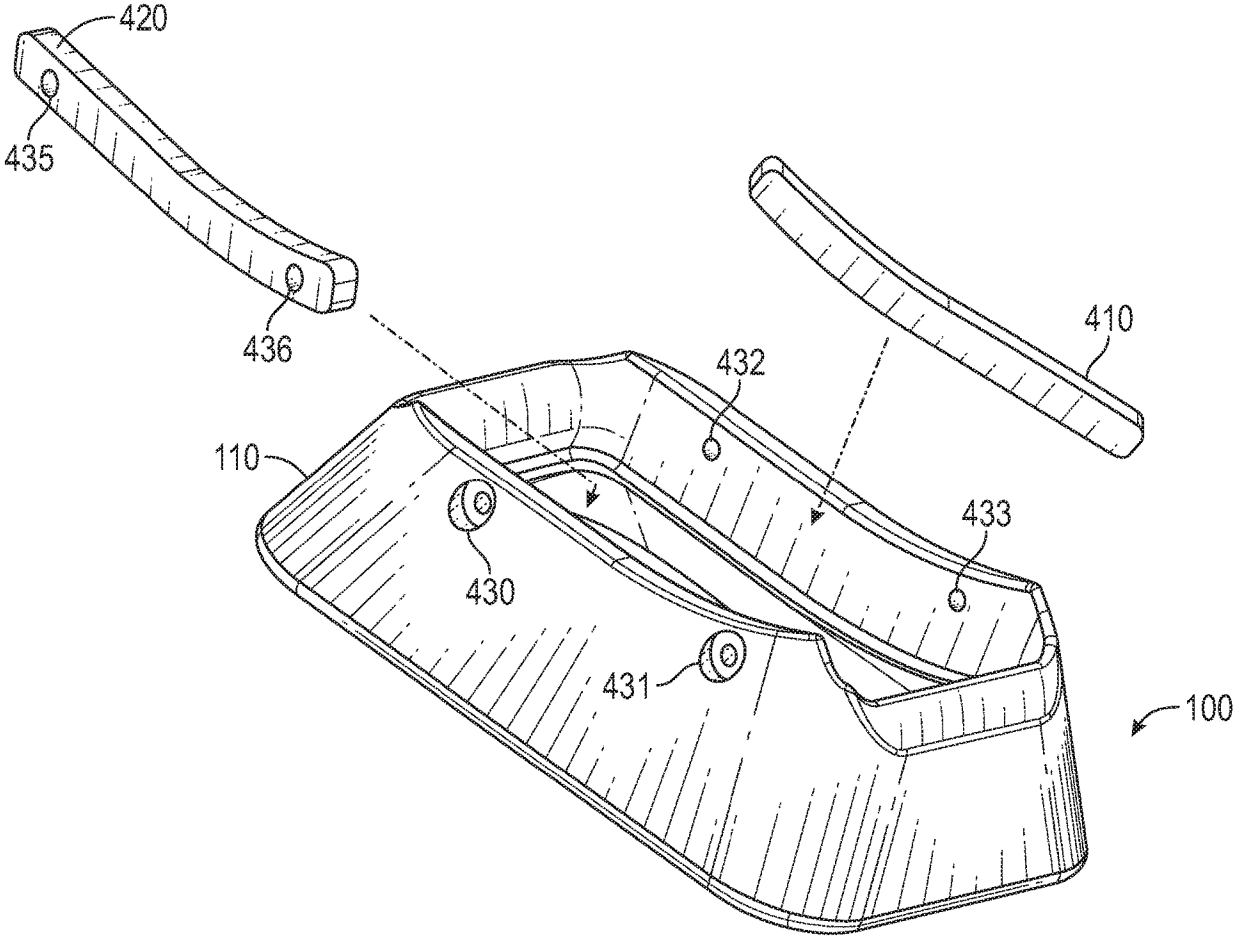
FIG. 21 is a front, right, and top perspective view of a third embodiment of the magazine insertion funnel.

In each of the two embodiments described above, the magazine insertion funnel 100 is slid onto a flange 320 of firearm receiver 300. In additional embodiments, firearm receiver 300 does not have such a flange suitable for mounting magazine insertion funnel 100. Or firearm receiver 300 may have a flange that is not suitable for mounting magazine insertion funnel 100, such as because access to the flange is blocked by other components. To accommodate such receivers, a third embodiment is provided, as shown in FIG. 21. The third embodiment has an internal structure similar to either the first or second embodiment, but rather than the body 110 having an upper surface configured to slide onto firearm receiver 300, this third embodiment of magazine insertion funnel 100 is a simple push-on design. In this third embodiment, magazine insertion funnel 100 is pushed onto firearm receiver 300. Then, shims 410, 420 are inserted into side gaps between magazine insertion funnel 100 and firearm receiver 300. In this manner, the shims 410, 420 promote a tight fit between magazine insertion funnel 100 and firearm receiver 300.

The body 110 of magazine insertion funnel 100 is provided with four screw holes, 430, 431, 432, and 433, two per side, that penetrate entirely through the body 110. The screw holes 430, 431 correspond to screw holes 435, 436 that are threaded into shim 420. Similarly, screw holes 432, 433 correspond to screw holes, not shown, in shim 410. The screw holes in shims 410 and 420 do not penetrate to the sides of the shims that face the firearm receiver 300. When screws are placed into screw holes 430, 431, 432, and 433 and into the corresponding holes in the shims 410, 420, they secure the assembly together, for a semi-permanent attachment of the magazine insertion funnel 100 to firearm receiver 300.

Magazine insertion funnel 100 can be made from a variety of materials, but is preferably made from a thermoplastic such as polyoxymethylene, or from a metal, such as steel or aluminum, or from a resinous fiber. More preferably, magazine insertion funnel 100 is made from polyoxymethylene.

While preferred embodiments of the present invention have been illustrated and described herein, it will be apparent that such embodiments are provided by way of example only. Numerous variations, changes and substitutions will be apparent to those skilled in the art without departing from the invention, the scope of which is to be determined by the following claims.

The invention claimed is:

1. A magazine insertion funnel for facilitating the insertion of a magazine into a generally rectangular aperture in a firearm receiver, the magazine insertion funnel comprising:

a body with a central well, the central well including a narrow opening and a wide opening, the narrow opening configured to align adjacent to the aperture and to have dimensions approximately equal to those of the aperture, and the wide opening configured to be distal from the aperture and to have dimensions larger than those of the aperture, the central well including an axis through a center of the narrow opening and a center of the wide opening, wherein the central well comprises a narrow section, a wide section, and a waist dividing the narrow section from the wide section, the waist having a circumference greater than that of the narrow opening but less than that of the wide opening, wherein the narrow section extends from the narrow opening to the waist, and comprises a first frustorectangular shape at a first acute angle with reference to the axis, wherein corners between the four walls of the first frustorectangular shape are filleted, and wherein the wide section extends from the waist to the wide opening, and comprises a second frustorectangular shape at a second acute angle with reference to the axis, the second acute angle being greater than the first acute angle, and wherein corners between the four walls of the second frustorectangular shape are filleted.

2. The magazine insertion funnel of claim 1, wherein the body includes an upper surface and a pair of securing members, the securing members each including a leg portion that terminates in an inwardly disposed flange, such that the magazine insertion funnel is configured to be slid onto a flange of the firearm receiver, with the securing members gripping the flange such that the upper surface rests against the bottom of the flange.

3. The magazine insertion funnel of claim 2, wherein the body includes a hole through which, after the magazine insertion funnel is slid onto the flange of the firearm receiver, a screw can be passed to prevent the magazine insertion funnel from being able to slide off the flange, thus semi-permanently securing magazine insertion funnel to the firearm receiver.

4. The magazine insertion funnel of claim 1, wherein the waist is in a first plane that is parallel to a second plane of the wide opening.

5. The magazine insertion funnel of claim 1, wherein the waist is in a first plane that is parallel to a second plane of the narrow opening.

6. The magazine insertion funnel of claim 1, wherein the waist is in a first plane that is parallel to a second plane of the narrow opening and a third plane of the wide opening.

7. The magazine insertion funnel of claim 2, wherein the upper surface is in a first plane that is parallel to a second plane of the wide opening.

8. The magazine insertion funnel of claim 2, wherein the upper surface is in a first plane that is not parallel to a second plane of the wide opening.

9. A magazine insertion funnel assembly including the magazine insertion funnel of claim 1, and further comprising two shims, wherein the body of the magazine insertion funnel is configured to be pushed onto the firearm receiver, and wherein the two shims are configured to be inserted into gaps between sides of the magazine insertion funnel and the firearm receiver, in order to wedge the magazine insertion funnel in place.

10. The magazine insertion funnel assembly of claim 9, wherein the body and the shims includes holes for one or more screws to be inserted through the body and into each of the two shims, after the shims are inserted into the gaps between the sides of the magazine insertion funnel and the firearm receiver.

* * * * *